US005279470A

United States Patent [19]

Birkmann et al.

[11] Patent Number: 5,279,470

[45] Date of Patent: Jan. 18, 1994

[54] WINDING MANDREL TENSIONING MEANS

[75] Inventors: Josef Birkmann, Fuerstenfeldbruck; Friedrich Held, Planegg; Gottfried Lutz, Seefeld; Bernd Scholtysik; Jose Toral, both of Munich, all of Fed. Rep. of Germany

[73] Assignee: BASF Magnetics GmbH, Mannheim, Fed. Rep. of Germany

[21] Appl. No.: 904,928

[22] Filed: Jun. 26, 1992

[30] Foreign Application Priority Data

Jun. 27, 1991 [DE] Fed. Rep. of Germany ..... 4121244

[51] Int. Cl.[5] ..... B65H 18/04; B65H 75/24

[52] U.S. Cl. ..... 242/56.9; 242/72 R

[58] Field of Search ..... 242/56.9, 68.2, 72 R, 72 B, 46.2, 46.4, 46.5, 46.6

[56] References Cited

U.S. PATENT DOCUMENTS

| | | | |
|---|---|---|---|
| 2,274,681 | 3/1942 | Fletcher | 242/72 R |
| 2,620,140 | 12/1952 | Naegeli | 242/46.6 |
| 3,544,016 | 12/1970 | Cunningham et al. | 242/46.5 |
| 3,871,592 | 3/1975 | Kallenborn | 242/46.5 X |
| 4,026,488 | 5/1977 | Hashimoto | 242/72 B |
| 4,198,007 | 4/1980 | Schoettle et al. | 242/56.9 |
| 4,893,761 | 1/1990 | Gay | 242/46.4 |

FOREIGN PATENT DOCUMENTS

| | | | |
|---|---|---|---|
| 0250898 | 1/1988 | European Pat. Off. . | |
| 0297609 | 1/1989 | European Pat. Off. . | |
| 1050964 | 2/1959 | Fed. Rep. of Germany . | |
| 1056594 | 1/1967 | United Kingdom | 242/46.5 |

*Primary Examiner*—John M. Jillions

[57] ABSTRACT

A winding shaft is described, having self-tensioning individual winding elements (6) for winding mandrels mounted on it in such a way that they can be driven, which include in each case in an annular groove (14) of each individual winding element a compliant tensioning means, the outside diameter of which is greater than the inside diameter of the winding mandrels. The winding means comprises a plurality of cylindrical-annular segments (2) arranged on the circumference of the individual winding element in the annular groove, the end faces (13) of which segments are beveled and are mounted radially displaceably on the inner face of the intermediate pieces (3), there being seated between the inside of the segments and the bottom of the annular groove a spring element, comprising either a leaf spring or a plurality of helical springs with ball thrust pieces.

2 Claims, 3 Drawing Sheets

WINDING MANDREL TENSIONING MEANS

FIELD OF THE INVENTION

The invention relates to a winding shaft having self-tensioning individual winding elements for winding mandrels mounted on it in such a way that they can rotate and be driven, a compliant tensioning means being inserted in each case in an annular groove of each individual winding element, the outside diameter of which means is greater than the inside diameter of the winding mandrels, the compliance of the tensioning means allowing the winding mandrels to be pushed on by sliding in the axial direction by virtue of the fact that the tensioning means includes spring elements which are compliant in the radial direction.

BACKGROUND OF THE INVENTION

In winding machines, in particular in combined slitting and winding machines, for example for magnetic tapes, the winding shafts each take a multiplicity of winding mandrels. Fitting the shafts with winding mandrels is problematical, since the numerous wound mandrels are to be drawn off the winding shaft very quickly and replaced by empty winding mandrels in the correct position. The tensioning means should not hinder easy, trouble-free displacing of the winding mandrels on the shaft during fitting. Therefore, numerous tensioning means on the winding shaft are already known, such as tensioning rollers, tensioning pins or the like. These tensioning means are mechanically complex constructions which force up the costs of the winding shaft. The difficulties become that much greater if individual winding elements with separate frictions are used.

EP 0,250,898 discloses a tensioning means which comprises a rotatably mounted block which is seated on a circular disk and includes as tensioning elements two opposite bushes which have in each case two spring-supported balls, the tensioning elements being at a distance from the circular disk, so that when pushed onto the block, the winding mandrel bears on one side against the circular disk and is arranged in the correct position on the other side by the tensioning elements. In the case of this arrangement, it is extremely disadvantageous that the fitting and removal of the winding mandrels on the shaft is extremely time-consuming.

DE 2,241,783 describes a tensioning means in which tensioning prisms are arranged on both sides of a winding mandrel along a regular polygon, lying parallel to the base area of the winding mandrel, and are in each case rotatable about the prism edge.

Tensioning means of the abovementioned generic type are described in the applications DE-U 8,815,051. A winding mandrel holder is described, comprising an annular leaf spring and a rubber pad lying underneath, which is intended to prevent unwanted turning of the leaf spring and to increase the flexibility of the leaf spring.

EP 0,133,648 and 0,356,744. In this case, the tensioning means is designed as a shaft ring or hub rim which is compliant in the radial direction or as a tensioning ring having tongues directed alternately against each other, which rests on a compliant underlay, such as for example an O-ring or a rubber band.

EP 0,297,609 describes as tensioning element circular-cylindrical segments which are held together by a spiral spring lying in a central groove, silicone tubes being arranged as resilient elements on both sides between inner ring and the segments.

In the case of the abovementioned applications, it is disadvantageous that the spring effect is not timestable and, moreover, there is inadequate spring excursion, so that, at least after prolonged use, the positionally stable fixing of the winding mandrels on the tensioning means is no longer ensured and therefore the winding performance is unsatisfactory.

SUMMARY OF THE INVENTION

It is an object of the present invention to provide a tensioning means of the abovementioned generic type, in which the individual winding element has a smooth surface, in order to reduce the abrasion when pushing the winding mandrels on and off the spring excursion is to be great the tensioning force of the spring element can be varied simply by means of its dimension little installation space is required, in order to permit a large diameter of the winding shaft.

We have found that this object is achieved by a winding shaft having self-tensioning individual winding elements for winding mandrels mounted on it in such a way that they can rotate and be driven, a compliant tensioning means being inserted in each case in an annular groove of each individual winding element, the outside diameter of which means is greater than the inside diameter of the winding mandrels, the compliance of the tensioning means allowing the winding mandrels to be pushed on by sliding in the axial direction by virtue of the fact that the tensioning means includes spring elements which are compliant in the radial direction, wherein the tensioning means includes a plurality of cylindrical-annular segments distributed along the circumference of each individual winding element, the mutually facing end faces of which segments are beveled and are arranged radially displaceably on the inner face, running at a similar bevel angle, of an intermediate piece arranged in each case between two segments and firmly connected to the bottom of the groove, and one or more spring elements being seated between the bottom of the annular groove (14) and the inner face of the segments.

SHORT DESCRIPTION OF THE DRAWINGS

The invention is now explained in more detail with reference to the drawings, in which:

FIG. 1 shows a longitudinal section through a tensioning means according to the invention, FIG. 2 shows a cross section through a part of the tensioning means according to FIG. 1, FIGS. 3 and 4 show corresponding longitudinal and transverse sections, respectively, of another embodiment according to the invention, FIG. 5 shows a longitudinal section through a further embodiment, FIGS. 6 and 7 show cross sections through further embodiments of the centering means for the winding mandrels.

DETAILED DESCRIPTION OF THE INVENTION

Figure 1:
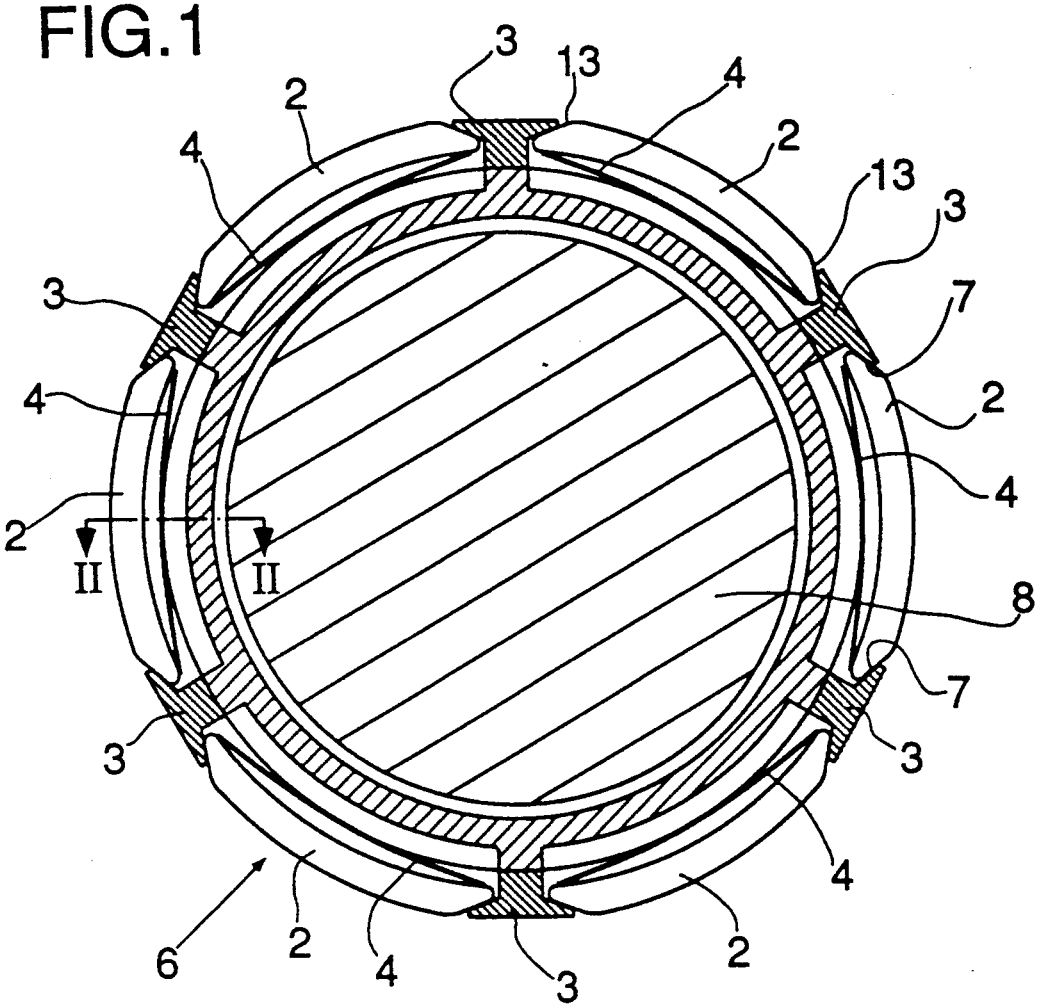
Figure 2:
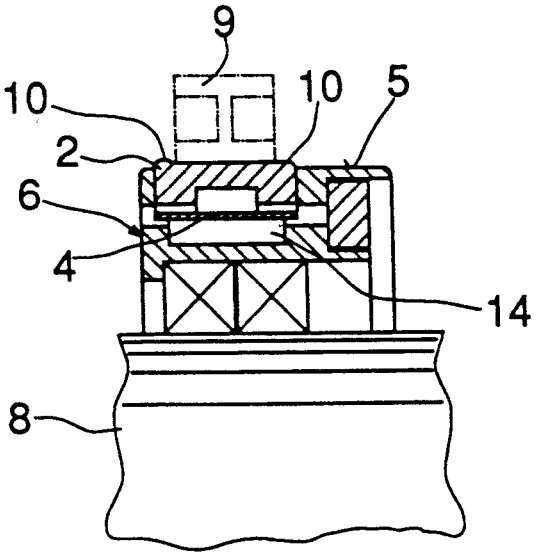

FIGS. 1 and 2 show a preferred embodiment of the present invention. Seated on a winding shaft (8) along-side one another are individual winding mandrels (6) (only one is drawn in each case) having an encircling annular groove (14), in which the tensioning means to be described in detail is seated. The torque transfer between winding shaft and individual winding elements can take place by means of an eddy current coupling, a friction coupling, which is for example pneumatically loaded, or a mounting braced in some way, but is not covered by this invention.

A plurality of cylindrical-annular segments (2), both end faces (13) of which are beveled, are arranged in the annular groove. The anchoring of the described segments takes place by cross-sectionally mushroom-shaped intermediate pieces (3) fastened in each case between two segments on the bottom of the annular groove, said intermediate pieces being correspondingly inversely beveled (7) in relation to the end faces (13) of the segments. Inserted between the bottom of the annular groove (14) and the inner face of the segments (2) as a spring element is a leaf spring (4), which is supported by each of its two free ends against the end of the segment and by its central part against the bottom of the annular groove. The dimensions of the leaf spring determine the tensioning force of the tensioning element. The outer surface of the segments (2) protrudes slightly above the circumferential surface (5) of the individual winding element (6). The intermediate pieces (3) bound the radial spring excursion of the segments (2) toward the outside. In addition, the intermediate pieces (3) prevent turning of the segments (2) in the circumferential direction being caused by the torque transfer of the individual winding element (6) to the winding mandrel (9).

In order to permit satisfactory centering on the individual winding element of the winding mandrel (9) which can be pushed axially onto the tensioning means (2, 4), each segment has an annular bead (10) on both sides of its outer surface, the spacings of the two annular beads corresponding to the width of the winding mandrel.

Figure 3:
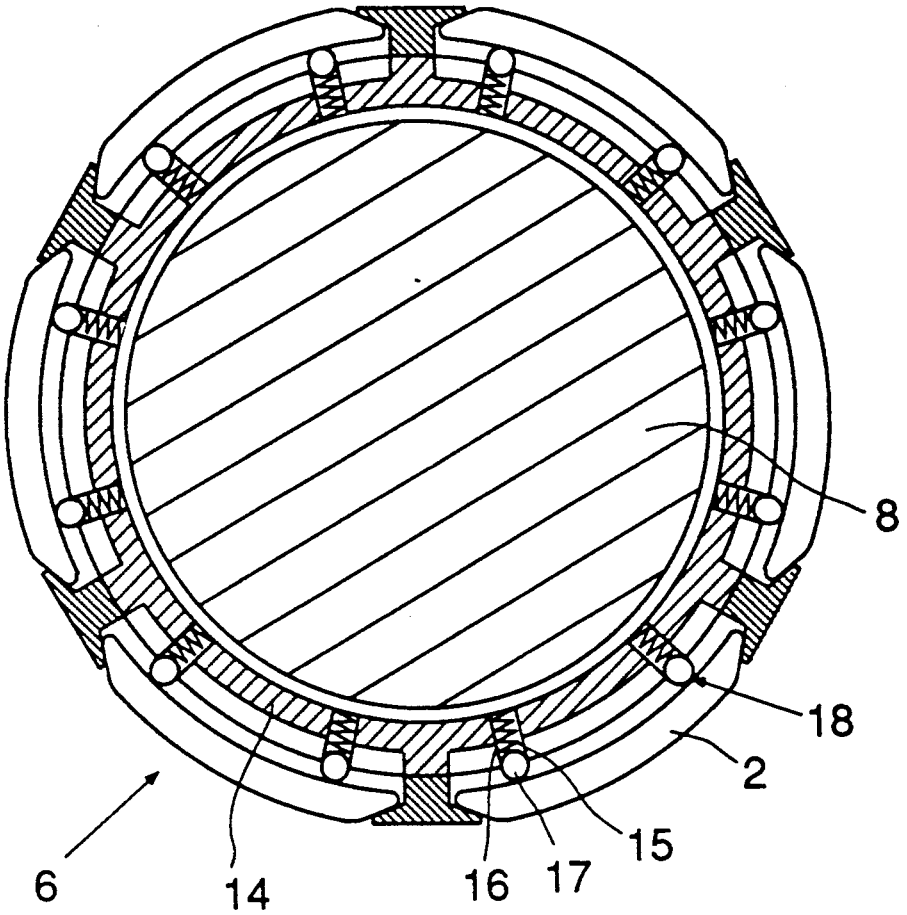
Figure 4:
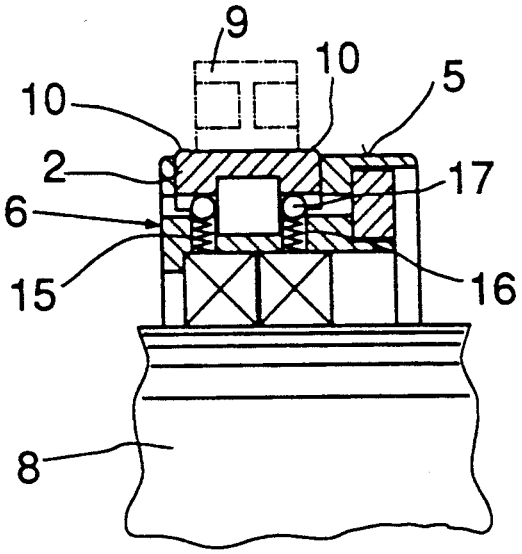

Another, likewise preferred version is represented in FIGS. 3 and 4. In this case, four spring elements (18) per segment are provided in each case, comprising helical springs (15), which are fitted in sleeves (16) which are inserted in the bottom of the annular groove (14) and bear at their free end ball thrust pieces (17), which press against the inside of the segments (2). In this arrangement, two spring elements of the type described are in each case arranged on both sides at both ends of the segment.

Figure 5:
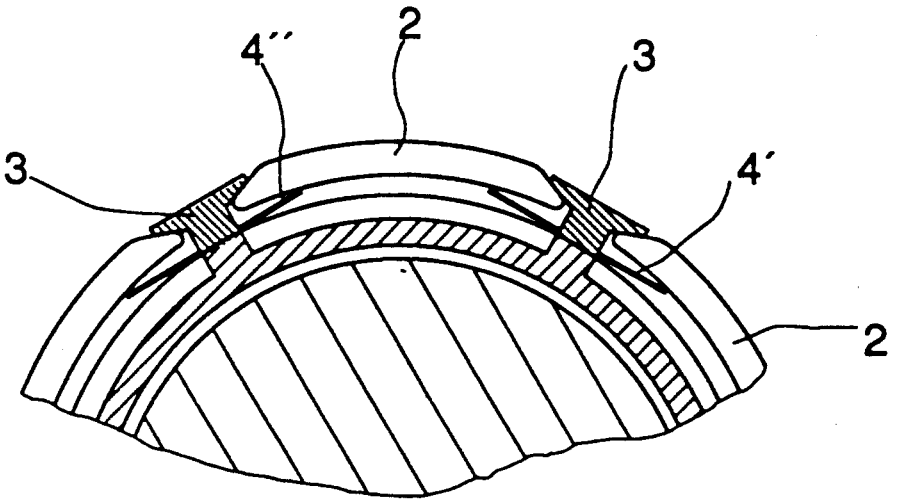
Figure 6:
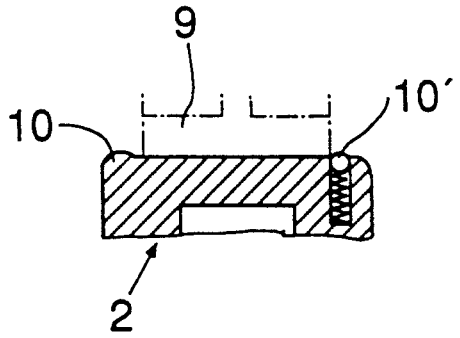
Figure 7:
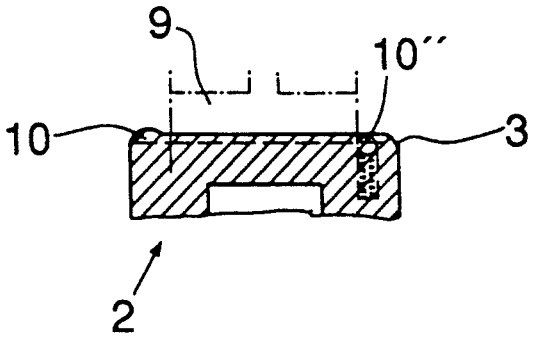

The arrangements described above still allow numerous variations, some of which are illustrated in FIGS. 5 to 7. As can be seen from FIG. 5, the leaf spring (4') may be provided in its central part with an opening and is fastened with the intermediate piece (3) on the bottom of the annular groove, whereas it bears with its two free ends against the insides of two neighboring segments (2), likewise the next-following leaf spring (4') and so on.

Similarly, as can be seen from FIG. 6, the bead (10) may be arranged only on one outer side of the segment (2), whereas a spring-loaded ball thrust piece (10') is arranged on the opposite side and in this way represents a snap-in or centering means for the winding mandrel (9). A further variation can be seen from FIG. 7. In this case, the winding mandrel butts against a bead (10); this time, the ball thrust piece (10'') is provided on the intermediate piece (3) lying between the segments (2).

The tensioning means described achieve the objects underlying the invention and offer the advantages mentioned below.

A secure fixing of the winding mandrel and an accurate positioning at right angles to the axis of rotation, so that no eccentric running of the winding mandrels or lateral shifting can occur.

When the winding mandrels are pushed over, no abrasion occurs on account of the smooth surface of the segments.

There is a great spring tensioning range, which is important in particular since the inside diameter of the winding mandrel changes during winding of magnetic tape onto it.

Due to the small overall height, the winding shaft diameter can be chosen to be very large, as also revealed by the figures, so that only slight sagging of the winding shaft occurs even if a considerable length of tape, for example magnetic tape, has been wound onto the numerous winding mandrels pushed onto it.

Suitable as winding mandrels are what are known as NAB mandrels or winding mandrels according to DE 2,448,853, which have on both sides axial deformations which guard against displacing or turning of the mandrels stacked one on the other.

EXAMPLE

On a cutting machine, a 65 cm wide polymer base web, provided with a magnetic coating, is cut into about 50 strips, each 1.27 cm (½") wide, and the strips are in each case wound alternately onto two complete tensioning means at a rate of up to 500 m/min, so that on each winding shaft 25 tape rolls up to a length of 5,000 meters were in each case wound up on each winding mandrel, which results in an overall weight of the tape rolls of 50 kg on each winding shaft. With the described tensioning means according to the invention, a satisfactory winding profile was obtained.

We claim:

1. A winding shaft having self-tensioning individual winding elements for winding mandrels mounted on it in such a way that they can rotate and be driven, a compliant tensioning means being inserted in each case in an annular groove of each individual winding element, the outside diameter of which means is greater than the inside diameter of the winding mandrels, compliance of the tensioning means allowing the winding mandrels to be pushed on by sliding in the axial direction by virtue of the fact that the tensioning means includes spring elements which are compliant in the radial direction, wherein the tensioning means includes a plurality of annular segments (2) distributed along the circumference (5) of each individual winding element (6), intermediate pieces (3) arranged in each case between two segments and firmly connected to the bottom of the groove (14), and one or more leaf spring elements (4') being seated between the bottom of the annular groove (14) and the inner face of the segments, each of which spring elements is connected to the intermediate piece (3) via its central part, which is provided with an opening, and the two ends of each of said spring elements bear against the inside of two neighboring segments, and wherein the mutually facing end faces of the annular segments (2) and the intermediate pieces are beveled and are radially separable upon the application of pressure to the annular segments.

2. A winding shaft having self-tensioning individual winding elements for winding mandrels mounted on it in such a way that they can rotate and be driven, a compliant tensioning means being inserted in each case in an annular groove of each individual winding element, the outside diameter of which means is greater than the inside diameter of the winding mandrels, compliance of the tensioning means allowing the winding mandrels to be pushed on by sliding in the axial direction by virtue of the fact that the tensioning means includes spring elements which are compliant in the radial direction, wherein the tensioning means includes a plurality of annular segments (2) distributed along the circumference (5) of each individual winding element (6), intermediate pieces (3) arranged in each case between two segments and firmly connected to the bottom of the groove (14), and one or more leaf spring elements (4) being seated between the bottom of the annular groove (14) and the inner face of the segments, each of which spring elements has a length which corresponds approximately to the length of the segment (2) and the two ends of which are supported against the inside of the segment, whereas the central part of the spring is supported against the bottom of the annular groove (14), and wherein the mutually facing end faces of the annular segments (2) and the intermediate pieces are beveled and are radially separable upon the application of pressure to the annular segments.

* * * * *